United States Patent [19]

Duclaux et al.

[11] Patent Number: 4,465,578

[45] Date of Patent: Aug. 14, 1984

[54] APPARATUS FOR THE PRECISE ADJUSTMENT OF THE ANODE PLANE OF AN ELECTROLYSIS CELL USED IN THE PRODUCTION OF ALUMINUM

[75] Inventors: Daniel Duclaux, Seiches s/le Loir; Roger Boinet, Lille; Jean-Louis Gerphagnon; Jean Baghe, both of St. Jean de Maurienne, all of France

[73] Assignee: Aluminium Pechiney, Lyons, France

[21] Appl. No.: 442,309

[22] Filed: Nov. 17, 1982

[30] Foreign Application Priority Data

Dec. 8, 1981 [FR] France ..... 81 23329
May 27, 1982 [FR] France ..... 82 09699

[51] Int. Cl.[3] ..... C25C 3/10; C25C 3/20

[52] U.S. Cl. ..... 204/245; 204/67; 204/225; 204/286

[58] Field of Search ..... 204/243 R-247, 204/225, 67, 297 R, 286

[56] References Cited

U.S. PATENT DOCUMENTS

| | | | |
|---|---|---|---|
| 2,061,146 | 11/1936 | Ferrand | 204/222 |
| 2,958,641 | 11/1960 | Reynolds | 204/225 |
| 3,219,570 | 11/1965 | Wonderli | 204/225 |
| 3,501,386 | 3/1970 | Johnson | 204/67 |
| 3,761,379 | 9/1973 | Elliott | 204/225 |
| 4,210,513 | 7/1980 | Mutschler et al. | 204/225 |
| 4,230,540 | 10/1980 | Archer et al. | 204/67 |
| 4,414,070 | 11/1983 | Spence | 204/225 |

FOREIGN PATENT DOCUMENTS

| | | | |
|---|---|---|---|
| 0017653 | 10/1980 | European Pat. Off. | 204/67 |
| 1325158 | 4/1962 | France . | |
| 2083362 | 12/1971 | France . | |

*Primary Examiner*—Howard S. Williams
*Assistant Examiner*—T. L. Williams
*Attorney, Agent, or Firm*—Dennison, Meserole, Pollack & Scheiner

[57] ABSTRACT

An apparatus for the precise adjustment of the anode plane of a cell for the production of aluminum by electrolysis of alumina dissolved in the molten cryolite of which the anodic system comprises a plurality of prebaked anodes arranged in two parallel lines and provided with suspension rods connected electrically to an anode bus bar which permits the positive intake of current. The apparatus comprises: a fixed gantry formed by at least one rigid horizontal beam provided with supports at its ends; a collective frame formed by two rigid horizontal elements each corresponding to a line of anodes, each supported by the fixed gantry via an assembly of rods and of levers which enable the two rigid elements to travel relative to the gantry in a rising or descending direction, while remaining horizontal; a means for controlling each assembly of rods and levers which is separate but can be coupled; a plurality of jacks for individually controlling the rise or descent of the anodes which are connected on the one hand to the collective frame and on the other hand to a plurality of small individual frames, electrical and mechanical connections between the small individual frames and the anode suspension frames; and the bus bars and the small individual frames being electrically connected.

5 Claims, 6 Drawing Figures

APPARATUS FOR THE PRECISE ADJUSTMENT OF THE ANODE PLANE OF AN ELECTROLYSIS CELL USED IN THE PRODUCTION OF ALUMINUM

The present invention relates to a process and an apparatus for the precise adjustment of the position of the anode plane of an electrolysis cell intended for the production of aluminum by electrolysis of alumina dissolved in molten cryolite (Hall-Heroult process).

In an electrolysis cell with prebaked anodes, the position of the anode plane facing the cathode layer of liquid aluminum has to be adjusted periodically to allow for the variation in a certain number of parameters such as:

(a) the depth of the layer of aluminum which increases evenly then decreases suddenly as the metal is extracted, (b) the gradual wear of the anode plane, (c) the occurrence of the phenomenon of polarization of the anode (covering), (d) the unevenness in the distribution of the current between the various anodes, (e) local heterogeneousness in temperature or composition of the bath, (f) irregularities in the contact resistances between the anode rods and the current supplies, (g) changes in the shape of the bath metal interface due to the variations in the pattern of the electric currents in the bath and in the metal.

Moreover, almost all the known processes for the control of electrolysis cells for the production of aluminum act by varying the distance between the anode and the cathode.

U.S. Pat. Nos. 2,545,411, 2,545,412, and 2,545,413 (Pechiney) describe a process and an apparatus for the adjustment of the electrodes of an electrolysis cell involving measuring the internal resistance of the bath and the distribution of the current between each anode, measured by a quotient meter with crossed fields, and giving each of them instructions to rise or fall so as to correct the deviations from the set values. Furthermore, the movement of the electrodes ensured a gradual decrease in the alumina in the cell and thus automatic supply.

This design was used again, in particular in U.S. Pat. Nos. 2,904,490 (Ardal Og Sunndal), and 3,627,666 (Pechiney), and French Pat. No. 1,325,158 (ASEA).

It is now known that a distribution of current which is as even as possible between the various anodes of a cell is essential for obtaining a good yield.

In the large modern cells having a high number of anodes, the maintenance of this even distribution involves relatively frequent adjustments of the level of one or more anodes. This led back to the idea of controlling these adjustment movements individually and subjecting them to the value of the current circulating in each anode which formed the basis of the above-mentioned Pechiney Patents of 1944 and 1946.

U.S. Pat. No. 4,210,513 of Alcoa describes a pneumatic device for the individual positioning of the anodes in which a single motor transmits its movement to the individual jacks by means of a clutch permitting or preventing adjustment of the height of the relevant anode. For collective instructions for adjustment, all the clutches are engaged. This system has the following disadvantages:

(i) high cost of the jacks which have to have extended travel corresponding to the depth of wear or, strictly speaking, of semi-wear of the anode;

(ii) large bulk of these jacks having extensive travel, increasing the depth of the cell and therefore the financial outlay;

(iii) the need to have flexible and very long current supplies, thus an increase in the length of the leads;

(iv) the cost of the mechanical connections between the jacks which is higher than electrical connections;

(v) the speed of the rising or falling movement is constant whatever the nature of the adjustment to be effected. Precise individual adjustment cannot therefore be effected without impairing the duration of all the other operations.

The invention relates firstly to a process for the precise adjustment of the anode plane of a cell for the production of aluminum by electrolysis of alumina dissolved in molten cryolite, of which the anode system comprises a plurality of prebaked anodes arranged in two parallel lines and equipped with suspension rods connected electrically to a bus bar which allows the positive intake of current and of which the cathode plane is constituted by the layer of liquid aluminum produced, a process in which, in each line of anodes, the suspension rods for each anode or each group of anodes are connected on the one hand to some small individual jacks for the adjustment of height and, on the other hand, to the bus bar for the supply of current via a flexible foil, in that the small individual jacks of each of the two anode lines are fixed to a horizontal rigid collective frame, in that the two rigid collective frames are connected to each other and in that each rigid collective frame is connected to a separate height adjustment means which can be coupled.

According to this invention, the distance between the cathode plane and all the anodes is varied by synchronously acting simultaneously on the height adjustment means of each rigid collective frame and by interrupting the supply of the means for controlling the small individual jacks while the means for adjusting the rigid collective frames are in action.

According to this same invention, the intensity of the current passing in each anode or in each group of anodes is adjusted by measuring the intensity of this current, by comparing it to a set value, by producing a correction instruction which is sent to each of the small individual jacks controlling the anodes or groups of anodes of which the intensity deviates from the set value and by interrupting the supply of the height adjustment means of the two rigid collective frames while the small jacks execute the correction instructions.

Finally, during the occurrence of covering (or "anode effect" of a cell) the supply to the means for controlling the small individual jacks is interrupted and the means for adjusting the height of each rigid collective frame is adjusted separately and synchronously so as to raise one of the frames by a predetermined height and simultaneously to lower the other frame by an identical height, each frame remaining horizontal, then the reverse operation is carried out, and so on several times until the covering has ceased, as demonstrated by the return of the voltage at the terminals of the cell to a value of approximately 4 volts. During this operation, the level of the electrolyte does not vary.

The invention also relates to an apparatus for the precise adjustment of the anode plane of a cell for the production of aluminum by electrolysis of alumina dissolved in molten cryolite of which the anode system comprises a plurality of prebaked anodes arranged in two parallel lines and equipped with suspension rods connected electrically to a bus bar which permits the positive intake of the current and of which the cathode plane is constituted by the layer of liquid aluminum produced, the apparatus comprising:

(a) a fixed gantry formed by at least one rigid horizontal beam provided with a support at its ends;

(b) a collective frame formed by two rigid horizontal elements each corresponding to one line of anodes, each line being supported by the fixed gantry via an assembly of levers and small rods permitting the two rigid elements to travel upwards or downwards relative to the gantry while remaining horizontal;

(c) a means for the control of each assembly of levers and small rods which is separate but can be coupled;

(d) a plurality of means for the individual control of the anodes connected on the one hand to the collective frame and on the other hand to a plurality of small individual frames;

(e) means for mechanical connection between small individual frames and the anode suspension rods;

(f) if necessary, rigid or articulated means for mechanical connection between the two rigid elements of the collective frame;

(g) means for the electrical connection between the bus bar and the anode suspension rods.

IN THE DRAWINGS

Figure 4:
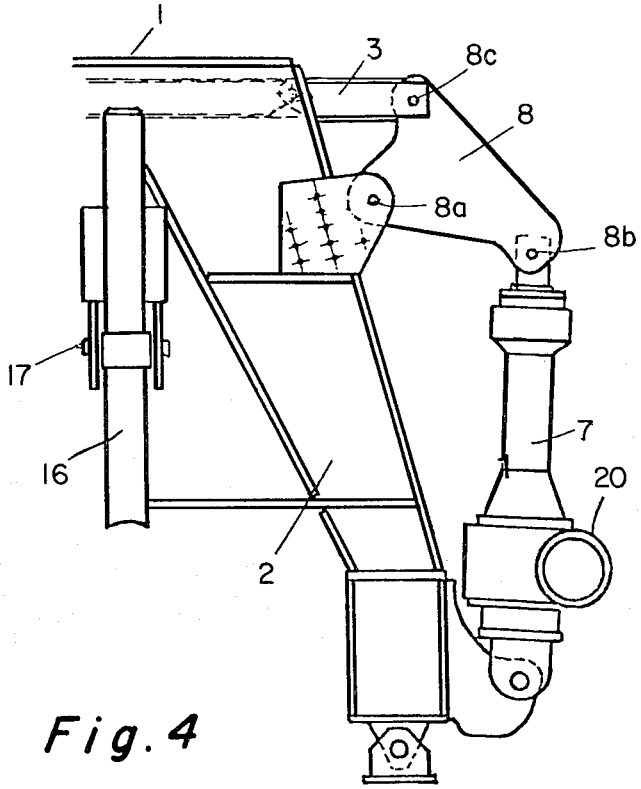
FIG. 4 is a lateral view of the control jack of one of the two collective frames.
Figure 5:
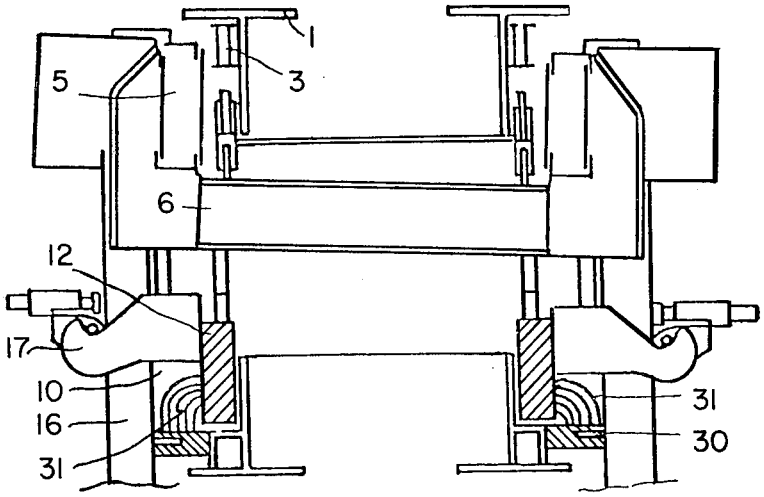
FIG. 5 is a transverse view of the position of the auxiliary frames.
Figure 6:
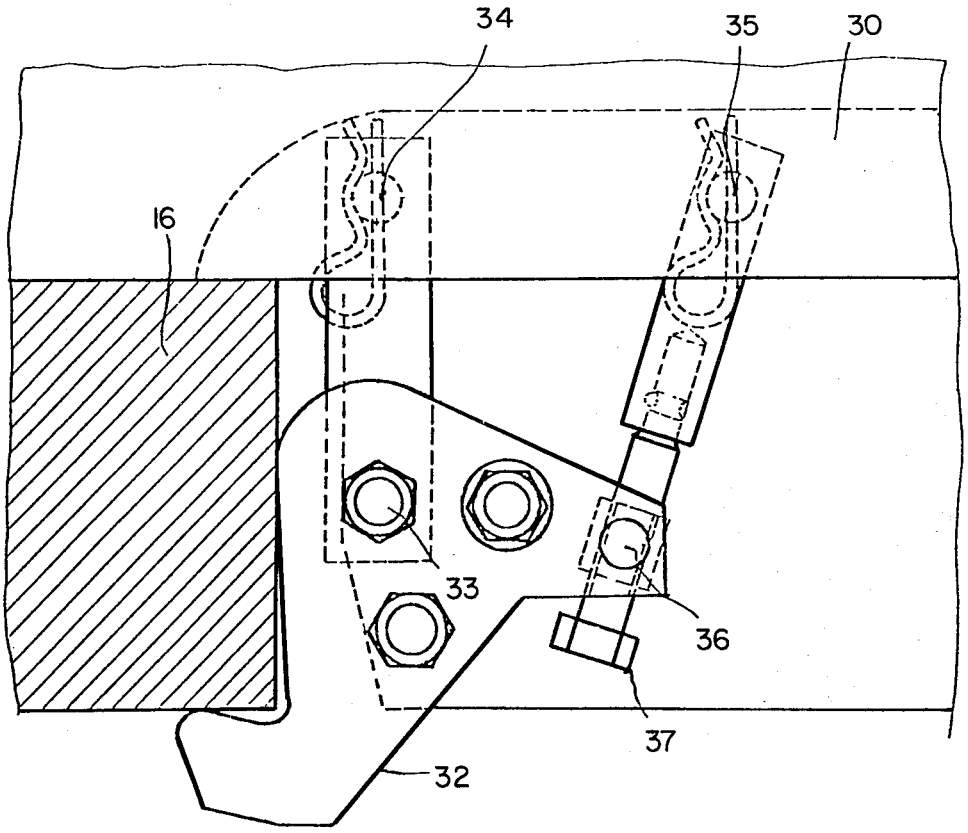
FIG. 6 is a plan view of the lifting connector.

The superstructure of the cell is constituted by a steel gantry formed by two rigid horizontal beams 1,1' supported at their ends on two feet 2, only one being shown, (FIG. 4). On each beam there is fixed an assembly of rods 3,3' and levers 4, which support a rigid collective frame made of steel and composed of two tubular beams 5,5' each corresponding to a line of anodes which are interconnected by means of connecting crossbars 6.

This connection can be rigid, as shown in FIG. 4, or articulated. The two systems of rods 3,3' and levers 4, are actuated by two mechanical screw jacks 7, which are fixed on one of the feet 2 of the gantry, each jack causing the rigid frame 5,5' to rise or fall via the end levers 8. The levers 4 are fixed to the fixed beam by the articlation **4*a* and are connected to the two portions of the rod 3 via the articulations 4*b* and 4*c* and they act on the tubular beam 5 via the small rod 40 connected to the lever 4 via the articulation 4*d* and to the beam 5 via the articulation 5*a***.

The end lever 8 is secured to the fixed beam via an articulation **8*a* and to the head of the jack 7 via an articultion 8*b* and to the end of the lever 3 via the articulation 8*c***.

The collective frame 5, supports some small individual subframes 10 via small mechanical screw jacks 9.

The electrolysis current is supplied in the conventional manner via rigid positive uprights as shown at 11 to a fixed cross piece made of aluminum comprising two horizontal bars 12,12' connected by equipotential crossbars 13.

The current is distributed over aluminum lugs 14,14' via flexible foils 15,15'. The lugs 14 are immobilized in the individual frames 10 on which the anode rods 16 come into contact.

The device 17 for gripping the anode rods 16 on the individual frames 10 can be of any known type, for example, the one forming the subject of U.S. Pat. No. 3,627,670, the gripping screw being in the horizontal, not the vertical position in the case illustrated.

Moreover, in order to carry out the operation for lifting the frames which will be explained below, means for connecting the anode rods 16 to the main bus bar has been provided to allow the passage of the anode current during the lifting operation.

This means comprises, for each anode or each group of anodes, an aluminum stud 30 known as false frame or auxiliary frame, supplied electrically from the main bus bars 12 and 12' via flexible foils 31. This auxiliary frame 30 rests on a support connected rigidly to the beams 1 and 1', preventing it from moving downwards. It also comprises a small simplified connector 32 of which the strength is just sufficient for supporting the weight of an immobile anode. It is therefore inexpensive. It comprises the actual connection member 32 which is articulated at four points 33, 34, 35, 36 forming a quadrilateral. The gripping and releasing movement is permitted by rotation of the screw jack 37 controlled by an appropriate tool of simple design. Each sub-assembly of jack 9 and individual subframe 10 supports a pair of anodes 18, 19. This specific arrangement is not essential and the scope of the invention would not be departed from by causing each jack to control a single anode or more than two.

The small individual jacks 9 can be actuated either by a respective electric or pneumatic motor or by a single motor distributing its movement via a set of driving shafts. In the latter case, the shaft-jack connection comprises a clutch permitting the jack to be actuated or not actuated when the common motor rotates. Furthermore, it is possible to provide means for guiding the anode rods.

The entire device just described can fulfill four functions:

1. Collective control of the anodes.

If the entire anode plane has to be raised or lowered so as to alter the distance between the anode and cathode as a function of the requirements of control, the small jacks 9 are not activated. The anodes are rigidly connected to the collective frames 5,5'. The jacks 7, are controlled simultaneously. A mechanical coupling 20 permits exact synchronization of their movement. The two beams 5,5' rise or fall simultaneously in sychronization and the anode plane travels parallel to itself. This mode of operation is equivalent to the one obtained by conventional mechanization.

2. "Uncovering" or deletion of the anode effect.

It is known that cells for the production of aluminum are subject to the so-called "covering" phenomenon, or again "polarization" or "anode effect" which is translated by a sudden increase in the potential drop at the terminals of the cell from approximately 4 volts to 35 or 40 volts with a correlative drop in the intensity. This phenomenon disturbs the cell which is affected by it and has repercussions in the entire row. It is generally attributed to the formation of a gaseous cover beneath the anode plane.

It is known that the anode effect can be overcome by various means such as the addition of alumina (of which the effect is not instantaneous), the blowing of compressed air beneath the anode plane, "perching", i.e. the introduction of a wooden perch beneath the anode plane which is difficult to implement in the completely hooded modern cells and also by a movement of the anodes which causes detachment of the cover of gas. In U.S. Pat. No. 2,061,146, L. Ferrand proposed rocking of the anode which was effective but awkward to carry out. The rising and falling movement of the anode plane which is effective and is frequently carried out at present has the disadvantage of causing the level of electrolyte to vary.

In the modern cells with continuous central supply, the height of the liquid bath is relatively significant and the ratio between the surface area of the anodes and the total surface area of the bath is high. The variations in the immersion of the anodes therefore cause great variations in the height of the bath. This has several disadvantages:

(i) to prevent the bath from overflowing out of the cell, the crucible has to be deepened, entailing a greater outlay;

(ii) a portion of the bath covers the top of the anodes and solidifies, reducing the volume of the liquid bath and therefore the ability of the cell to dissolve the alumina. The layer of solidifed bath thus covering the anodes during each falling operation finally becomes very large at the end of the life of the anodes. This gives rise to the additional problems of cleaning these anodes and recycling the solidified bath. Moreover, the liquid bath covering the anodes licks the steel cylinders 21, (which serve to support the anodes and to supply current) which are attacked, increasing the iron content of the aluminum produced.

The apparatus forming the subject of the invention permits the "uncovering" to be carried out at a constant bath level by lowering a line of anodes and simultaneously raising the other line of anodes by an equal height.

For this purpose, the coupling 20 between the two jacks 7 is removed or replaced by a crossed coupling permiting movements of identical range in opposing directions. A recording device such as a revolution counter on the motors or any known means for measuring the travel permit the jacks to be synchronized again and the level of the anode planes in each line of anodes to be made equal.

Figure 1:
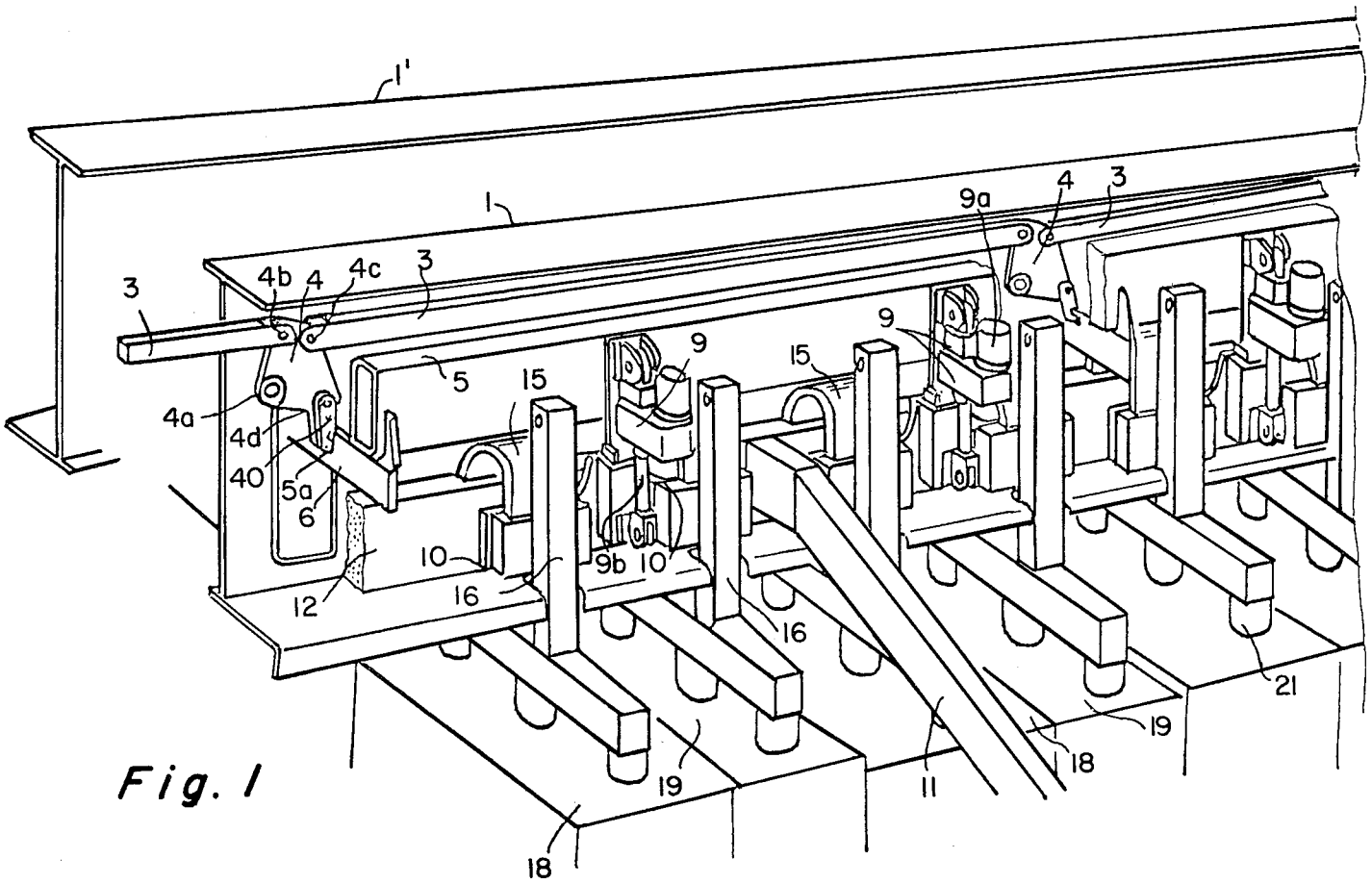
FIG. 1 is a partial and simplified perspective view of the apparatus in which the means for fixing the anode rods to the small frames have been omitted as they are known per se and do not form the subject of the invention.
Figure 2:
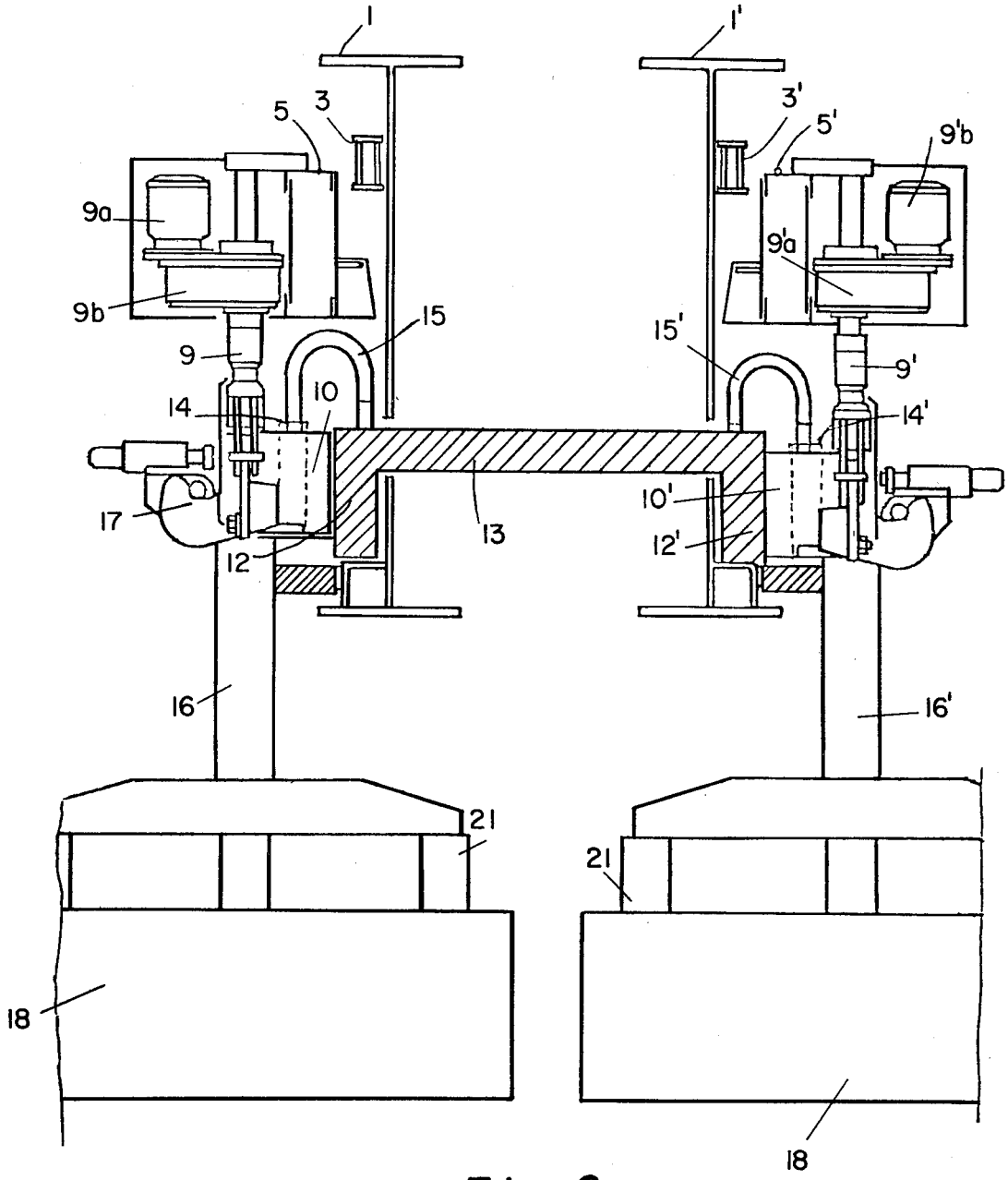
FIG. 2 is a transverse view at the level of the small jacks for the individual control of the anodes.
Figure 3:
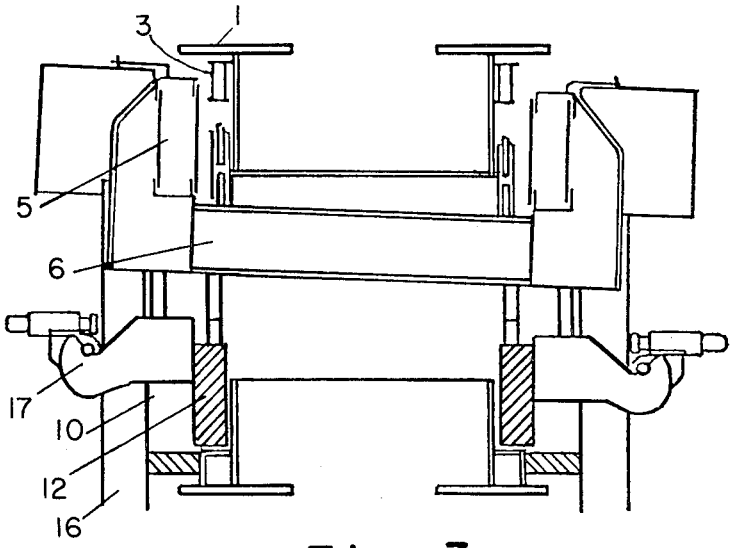
FIG. 3 is a transverse view of the rigid cross bar for connection between the two rigid elements of the collective frame.

If the connection between the two rigid elements of the collective frame is rigid (FIG. 3), the collective frame assumes during this operation a slight inclination which has repercussions in the anode plane, but its amplitude remains very low, of the order of a few degrees. Reciprocal rocking of the anode plane is thus created and causes horizontal movements of the bath without a variation in level.

If the connection between the two rigid elements of the collective frame is articulated, the anode plane remains perfectly horizontal during this vertical to and fro maneuver. Obviously, the same applies if the two elements of the collective frame are mechanically independent.

It is also possible to proceed with uncovering at a constant bath level without using the control jacks of the collective frames by acting solely on the small jacks 9. In particular, in a covered cell, instructions to descend can be given to all the small jacks situated on the right of the small axis of the cell and, simultaneously and in synchronization, instructions to rise by the same amount can be given to all the small jacks situated on the left of the small axis of the cell, and the opposite maneuver can be effected: instructions to rise on the right-hand and instructions to descend on the left-hand half and so on until covering has ceased.

In the aforementioned case, and in the hypothetical case of cells arranged transversely to the axis of the row, the twenty downstream anodes and the twenty upstream anodes were adjusted while, in the presence case, the twenty righthand anodes and the twenty left-hand anodes (relative to the axis of the row) were adjusted.

3. Individual control of the anodes.

If the intensity of the current traversing an anode or a group of two anodes in the case illustrated deviates from the set value, the control system, usually a computer, prepares an adjustment instruction which actuates the corresponding small jack 9 in the desired raising or lowering direction. During this operation, the jacks 7, are not controlled and the collective frames 5,5' remain fixed.

The range of the individual movement of each anode or group of anodes can be fixed at will. In a particular design applied to a row of electrolysis cells at 280,000 amps, comprising two lines of twenty anodes controlled in groups of two, this range was fixed at $\pm 30$ millimeters. The speed of rotation of these jacks may be low, making the adjustment very precise and permitting the current passing in each group of two anodes to be adjusted to 14,000 amps with a precision of $\div 1\%$. In these cells, the average distance between the anode and cathode layer of aluminum is of the order of 40 millimeters.

4. Supply of the anodes during lifting of the frames.

As the anodes wear away, the collective frames gradually descend. They therefore have to be raised periodically into the high position again. This operation, known as lifting of the frames, is usually carried out by keeping the anodes at their level by means of a lifting beam which the electrolysis bridge brings over the cell, the beam being provided with bells for gripping the anode rods and resting on the superstructure of the cell. A beam of this type has been described, in particular, in U.S. Pat. No. 3,434,955 in the name of Aluminum Pechiney. Once the anodes have been fixed to this beam, the main connections between the anode rods and the moving assembly are opened and the return of the collective frames 5 and 5' to the peak of their travel is controlled by means of collective jacks 7.

This method has the following two main disadvantages:

A. During the lifting operation, the current passes from the bus bar to the anode rods via the same contact as in normal operation. This is therefore a sliding contact. It is also of poor quality since the pressure of the rod on the bus bar is low with regard to the pressure exerted by a connector in spite of the adapted design of the lifting beam. This poor sliding contact, apart from the loss of energy which it causes, also gives rise to accelerated deterioration of the contact surfaces. Furthermore, there is an even greater risk of deterioration in the event of covering during the lifting operation as the voltage increases greatly at the terminals of the cell.

B. The lifting beam is a large bulky item which requires power to actuate its mechanisms. It is therefore manipulated with the electrolysis bridge. As the lifting operation is relatively long, the rate of occupation of the bridge is increased and this further reduces the number of bridges for a row. In addition, the positioning of the lifting beam and the bridge on the cell prevents the passage of other bridges above this cell, constituting an additional operating constraint.

The presence of the auxiliary frames 30 considerably simplifies this operation of lifting the frames which involves first gripping the anode rod 16 on the auxiliary frame 30 by means of the small lifting connector 32. The anode is thus connected electrically to the main feed bar 12 and mechanically to the auxiliary frame, and therefore to the fixed beam 1. The main connectors 17 can thus be released and all the collective frames 5, individual jacks 9 and studs for connecting the anode rods 10 and 14 can be raised. The main connectors 17 are then gripped again and the auxiliary connectors 32 released.

An additional manual or mechanized device can enable the auxiliary frame 30 to be removed from the anode rod 16 so as to prevent electrical contact at this point.

The two aforementioned disadvantages of the conventional apparatus disappear since the only tools needed for lifting the frames comprise manual or mechanised spanners for gripping and releasing the connectors, making the operation independent of the other operations and of the electrolysis bridge and, on the other hand, free and direct passage of the electric current is always permitted whatever the phase of the lifting operation under consideration.

Apart from these four main functions, the device forming the subject of the invention makes it possible, at the start up of a cell, to easily disconnect the connection between the small jacks 9 and the collective frame 5, permitting during preheating, when the anodes are positioned on the cathode, an electrical connection between the flexible foils 15 and the anode rods 16 while freely permitting expansion and movement of the anodes.

Moreover, the connections between the small jacks 9 and the small individual frames 10 can be designed so as to allow a certain degree of freedom to the anodes without harming the electrical contact between the anode rod 16 and the aluminum stud 14. The voltage drop at the anode bus bar junction 12 remains low in spite of the inaccuracy in the positioning of the anodes.

In addition, before changing an anode it is possible to lift it a little just before the operation. The current traversing it is reduced considerably and damage to the studs 14 by the arc effects is avoided when the rod 16 is detached from the stud 14.

Finally, the height of the studs 14 is small relative to the height of conventional bus bars, enabling the height of the cell to be reduced and the rods of anodes and the length of the conductor circuit to be reduced, thus considerably minimizing the initial investments and the voltage drops during operation.

In summary, implementation of the invention enables the position of the anode plane to be adjusted precisely at any moment, the current passing in each anode or group of anodes to be monitored, the rapid uncovering of the cell to be ensured without a variation in the level of electrolysis, thus permitting stable operation and an optimum yield, and periodic lifting of the frames to be effected without heavy auxiliary tools, ensuring free and direct passage of the anode current.

We claim:

1. In an apparatus for the precise adjustment of the anode plane of a cell for the production of aluminum by the electrolysis of alumina dissolved in molten cryolite and wherein the anode system comprises a plurality of prebaked anodes arranged in two parallel lines, suspension rods for the anodes electrically connected to a bus bar permitting the positive application of current and wherein the cathode consists of the produced layer of liquid aluminum, the improvement comprising;

(a) a fixed gantry defined by at least one rigid horizontal beam member (1) said beam member having support means (2) at the ends thereof, (b) a collective frame formed by two rigid horizontal elements (5,5'), each element corresponding to one of the lines of anodes, (c) means supporting said horizontal elements on said gantry beam permitting them to travel relative to the gantry beam in rising or descending directions while remaining horizontal, said supporting means including rod means (3,3') and lever means (4,), (d) a plurality of first jack means (7) for operation and control of each assembly of rod means and lever means, each first jack means being separately operable and adapted to be coupled for simultaneous operation of all of the first jack means, (e) a plurality of individual sub-frames (10) mechanically and electrically connected to the anode suspension rods, (f) a plurality of individual second jack means (9) interconnecting said collective frame and said sub-frames, said second jack means being adapted to individually control the rise and descent of the anodes connected to said sub-frames, and (g) means for electrically interconnecting said bus bar and said sub-frames.

2. Apparatus as defined in claim 1 and further including motor means for actuation of said first jack means and motor means for actuation of said second jack means, wherein the distance between the cathode plane and all of the anodes may be varied by synchronously actuating the motor means for all of the first jack means for adjusting the height of the collective frames and deactivating the motor means of the second jack means.

3. Apparatus as defined in claim 2, and further including means for decoupling each of the first jack means from each other and means for disconnecting the second jacks means from their motor means during lowering of the collective frames, whereby one frame may be raised to a predetermined height by operation of its first jack means while the other may be simultaneously lowered by the identical amount, each frame remaining horizontal and the molten cryolite level remaining constant, wherein said procedure may be repeated until cell voltage reaches approximately four volts, which is indicative of cell covering cessation.

4. Apparatus as defined in claim 2, and further including means for uncoupling the motor means for the first jack means and control means for selective actuation of the motor means for the second jack means during covering of the cell, said control means adapted to actuate the respective motor means to raise all of the second jack means on one side of the cell and simultaneously and in synchronization to lower all of the second jack means equally on the other side of the cell wherein reversal of the actuation of the second jack means several times while maintaining a constant level of molten cryolite will continue until cell voltage at the terminals is approximately four volts, designating that cell covering has ceased.

5. Apparatus as defined in claim 1 and further including motor means for said second jack means and control system means for actuating said motor means, including current measuring means, comparing means and a computer, for measuring current intensity through each anode and comparing it to a preselected value, whereby when anode current deviates from the preselected value correcting instructions are sent from the control system means to each of the motor means for the second jack means associated with those anodes having a current deviation, and means for decoupling said first jack means from movement during such second jack means operation.

* * * * *